US005096672A

United States Patent [19]

Tervamäki et al.

[11] Patent Number: 5,096,672

[45] Date of Patent: Mar. 17, 1992

[54] CUVETTE MATRIX AND ITS TRAY

[75] Inventors: Jukka Tervamäki; Kari Vauramo, both of Helsinki, Finland

[73] Assignee: Labsystems Oy, Helsinki, Finland

[21] Appl. No.: 573,377

[22] Filed: Aug. 24, 1990

[30] Foreign Application Priority Data

Aug. 28, 1989 [FI] Finland ..... 894025

[51] Int. Cl.[5] ..... B01L 3/14

[52] U.S. Cl. ..... 422/102; 422/99; 422/104; 206/558; 206/560; 220/23.4; 220/23.83; 220/23.86

[58] Field of Search ..... 422/102, 104, 99; 206/443, 446, 558, 560; 220/23.4, 23.6, 23.83, 23.86

[56] References Cited

U.S. PATENT DOCUMENTS

| | | | |
|---|---|---|---|
| 3,175,695 | 3/1965 | Goodman et al. | 211/74 |
| 3,470,851 | 10/1969 | Cannon | 220/23.6 |
| 3,713,985 | 1/1973 | Astle | 435/301 |
| 4,154,795 | 5/1979 | Thorne | 206/460 |
| 4,472,357 | 9/1984 | Levy et al. | 422/102 |

FOREIGN PATENT DOCUMENTS

| | | |
|---|---|---|
| 902982 | 11/1985 | Belgium . |
| 0035779 | 9/1981 | European Pat. Off. . |
| 0106662 | 4/1984 | European Pat. Off. . |
| 0114056 | 7/1984 | European Pat. Off. . |
| 0188009 | 7/1986 | European Pat. Off. . |
| 0365827 | 5/1990 | European Pat. Off. . |
| 2601452 | 1/1988 | France . |
| 2064998A | 6/1981 | United Kingdom . |

*Primary Examiner*—Robert J. Warden
*Assistant Examiner*—Laura E. Collins
*Attorney, Agent, or Firm*—Hopgood, Calimafde, Kalil, Blaustein & Judlowe

[57] ABSTRACT

The invention concerns a cuvette matrix and its tray. The matrix comprises adjacent cuvettes (2) connected with one another by flexible connecting elements (3). The tray has an aperture (8) for each well, with a flexible clamping element (9).

11 Claims, 2 Drawing Sheets

CUVETTE MATRIX AND ITS TRAY

BACKGROUND OF THE INVENTION

This invention concerns a cuvette matrix comprising of rows of flexibly connected cuvette or wells and a tray therefor. If necessary, smaller parts of the matrix can be removed and put back into the tray. The cuvette matrix is especially suitable for use in different diagnostic measurements, for example EIA-assays. Cuvette matrices can, for example, form a so called microtitration plate.

Generally used for diagnostic assays are test plates formed by rows of cuvettes, for example, the so called microtitration plate into the cuvettes of which the samples are placed. Generally speaking a standard plate is used comprising 8>12 cuvettes with a distribution of 9 mm. Also known are cuvette sets in which a smaller part or segment of which can be removed, if necessary. Thus, it is not necessary to use the whole set, especially where there are only a few samples to measure.

U.S. Pat. No. 4,154,795 discloses a micro-titration plate the wells of which are connected to one another by rigid, straight stems. The stems can be broken and in this way it is possible to remove a predetermined amount of wells from the plate. The tray of the plate is equipped with posts placed in spaces between the wells. One problem with this solution is the fact that the wells do not stand upright in the tray properly, when the tray is moved. For example during stages of washing, it is often necessary to turn the tray upside down, whereby the wells tend to fall out. Also the fact that the different wells are at different heights in the tray can cause difficulties with the measuring device.

SUMMARY OF THE INVENTION

The cuvette matrix in accordance with the present invention and its tray with some of its favorable applications is disclosed in the claims.

An important aspect of the invention is the fact that the cuvettes are connected with one another with flexible connecting elements and the fact that there are flexible clamping elements in the tray to hold the cuvettes in place with help of the friction.

BRIEF DESCRIPTION OF THE DRAWINGS

In drawings of the detailed description of the invention

DETAILED DESCRIPTION OF THE INVENTION

The cuvette matrix in accordance with the invention is formed by straight rows of cuvettes, with one of them or several side by side. The matrix is advantageously made of some suitable plastic material by injection-moulding. The cuvettes are preferably cylindric cups or wells. For optical measurements, if necessary, their bottom is transparent. The matrices are suitable for use especially in different diagnostic assays on fluid samples, such as in EIA assays. If necessary, the cuvettes can be pretreated, for example the content can be coated with antigen of the antibody to be assayed.

At least a part of adjacent cuvettes of the matrix connected with one another by flexible connecting elements, that permit the cuvettes to move a little or provide play in relation to one another, at least horizontally. The connecting elements are situated in a way that the lower part of each cuvette can be put in the aperture of the tray described later. The connecting elements are preferably like stems and they are placed to connect the cuvettes at their top part. The required flexibility is attained by placing the stems at a distance from the centre line of the cuvette row. It is also possible to use curved stems right by the centre line.

The cuvettes are preferably connected to one another in a way that a desired amount of cuvettes can readily be removed from the matrix. The removability is preferably attained by employing connecting elements which are readily breakable.

The tray is formed by a frame with an aperture at least for one cuvette of the matrix. The aperture includes a flexible clamping element that fastens the cuvette into the aperture with help of the friction, preferably by pressing its lower part from the sides. The clamping element, anyway, provides sufficient play so that the cuvette can be pushed into the aperture. The clamping element may press the cuvette from one side or several sides. According to one embodiment the clamping element presses the cuvette against a rigid frame. The clamping element may comprise one or more flexible fingers. The finger is preferably flexible horizontally.

FIGS. 1–4 illustrate one application of the invention adapted to a micro test plate comprising apertures 8×12.

Figure 1A:
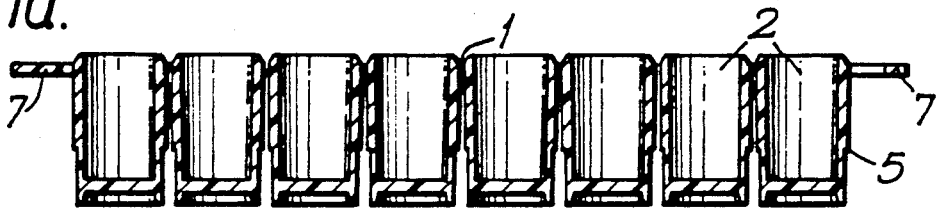
FIGS. 1*a* and 1*b* show one row-formed cuvette matrix in accordance with the invention as viewed from side and above.
Figure 1B:
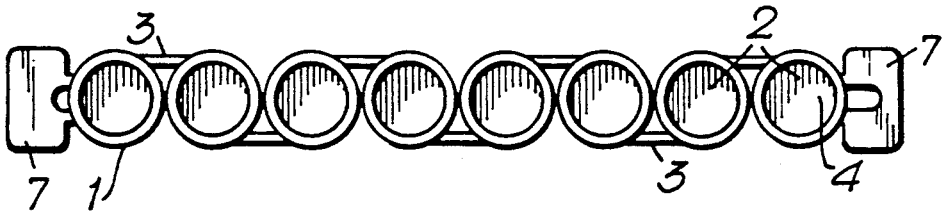
Figure 3A:
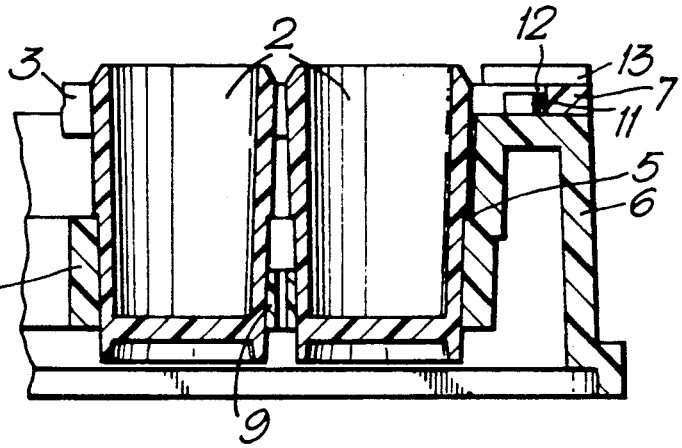
FIGS. 3*a* and 3*b* show a detail of the tray in accordance with FIGS. 2*a* and 2*b*, where the matrix in accordance with FIGS. 1*a* and 1*b* and one of its cuvettes has been placed in as viewed from side and above.
Figure 3B:
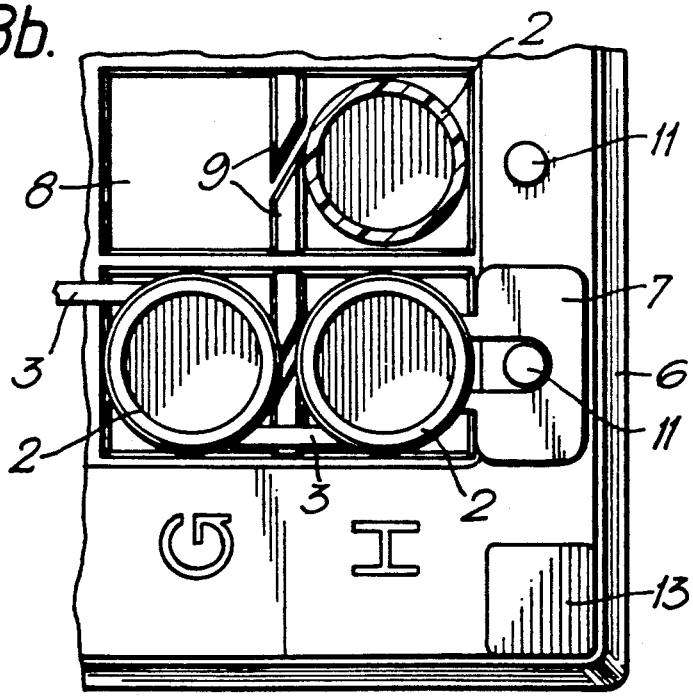

FIGS. 1*a* and 1*b* illustrate a one-row cuvette matrix 1. The single cuvettes, i.e. wells 2 thereof are preferably connected to one another by narrow stems 3. The stems 3 are fixed near the top part of the wells. The stems 3 are placed at a distance from the centre line of the cuvette row at sides of the cuvette row, so that the stems 3 next to each other are each in opposite sides. The stems 3 provide sufficient play so that each distance between adjacent wells 2 can get smaller and wider for some hundredths or tenths of a millimeter.

The inside of the wells 2 is cylindrical. Their bottom forms a light transmission measuring window. The window is protected against scratching with a collar around the window.

On the outer surface of the wells 2, slightly below the middle there is a shoulder 5, broader than the lower part of the well, which determine how deep the well can be pushed into the tray 6. The outer surface of the lower part of the well 2 is cone-shaped, tapered slightly downwards.

The stems 3 can be broken by hand. This enables the required amount of wells 2 to be readily removed.

In the both ends of the cuvette matrix there are flanges 7 at the top part, that can also be broken off.

Figure 2A:
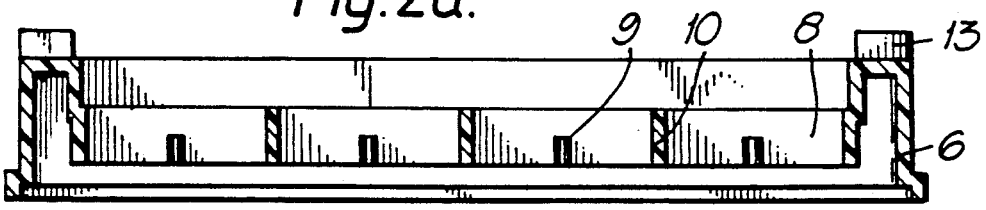
FIGS. 2*a* and 2*b* show one cuvette matrix tray in accordance with the invention as viewed from side and above.
Figure 2B:
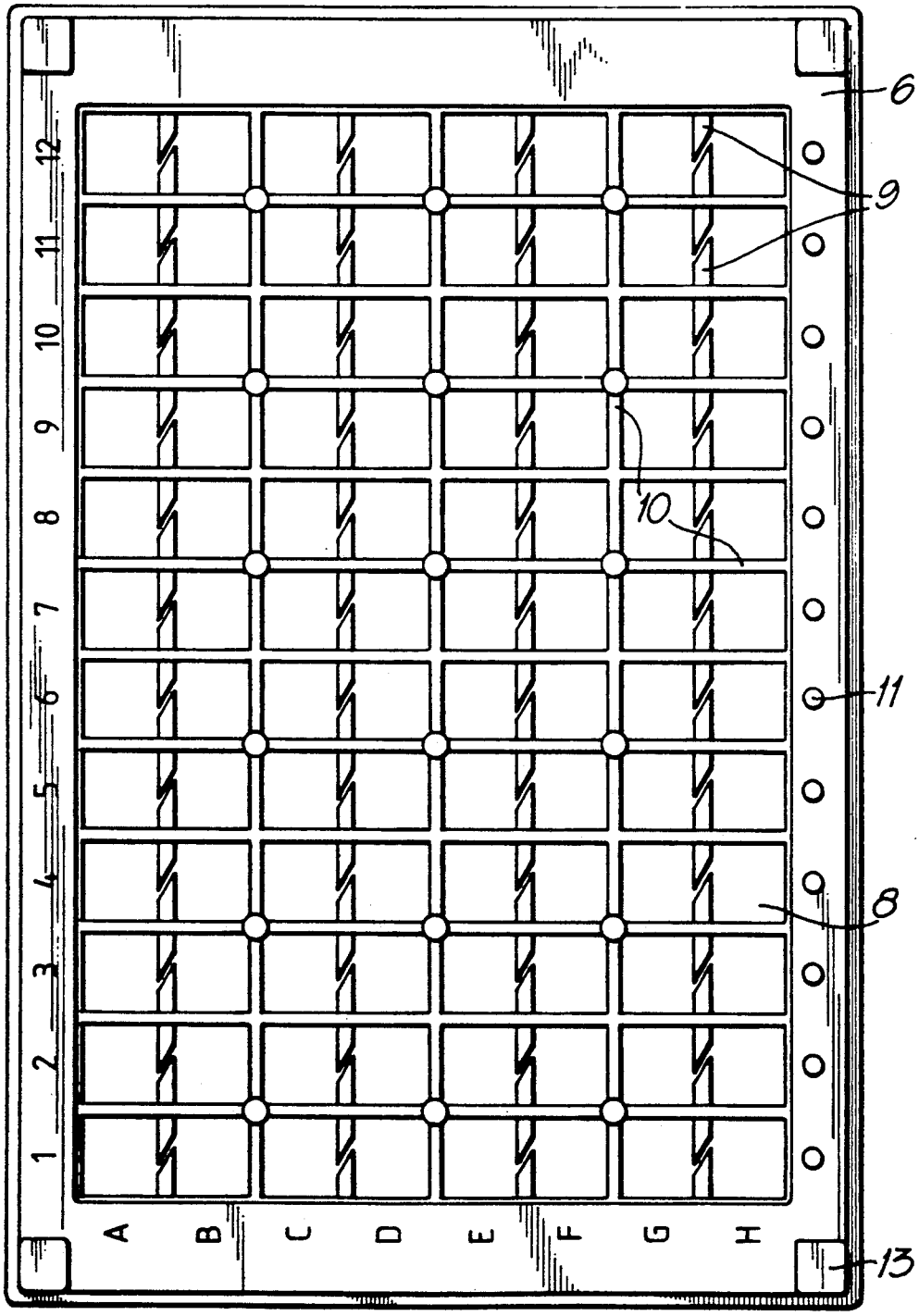

In the tray 6 in accordance with FIGS. 2*a* and 2*b* there are 8×12 apertures 8, in cross-sectional quadrangle shape. The side of the aperture 8 is slightly shorter than the biggest diameter of the lower part of the well 2. The apertures 8 form 8 rows, marked with letters (A–H) and 12 columns, marked with numbers (1–12) that is, 8×12. The apertures 8 are delimited by a rectangular frame with separation walls perpendicular to one another.

Separation walls parallel with the columns are integral and rigid. From the second separation wall on, from the side, every other wall parallel with the rows is also integral and rigid, the separation walls extending laterally and longitudinally across said frame.

From the first separation wall, from the side, each inward wall parallel with the rows is cut off or severed vertically at the centre line of the column, but diagonally against the separation wall and so that there is a small gap between the cut-off ends. The thus formed fingers 9, parallel with the separation walls of the rows, are slightly bent in horizontal direction. Thus, a well 2 can be pushed into each aperture 8, whereby the finger 9 bends away from the centre of the aperture. The finger 9 helps to keep the well 2 in the aperture with the aid of the friction.

The upper edge of the rigid separation walls 10 provides a stop for shoulder 5 on the outer surface of the well 2. Also on the sides of the tray the frame has ancons against the shoulders 5.

On the side of the tray there is a pin 11 at the lower end of each column. One head flange 7 of the cuvette matrix has a corresponding hole 12. Thus, the cuvette matrix is capable of being positioned the right way on the tray.

Lower edges of the tray extend lower than the bottoms of the wells 2 in the tray. Additionally, there are lips in the corners 13 of the tray to enable the trays to be readily piled.

We claim:

1. A cuvette matrix and tray therefor comprising at least one row of cuvettes flexibly interconnected one to the other by stems to allow for flexible play between each cuvette, each of said cuvettes being in the shape of a well of substantially cylindrical shape, each of said wells having an open top and a closed bottom, the cylindrical walls of each well being thickened at the upper portion thereof and slightly tapered at its lower portion to enable reception of said cuvette matrix by said tray, said tray for receiving said cuvette matrix comprising a frame having by rows of cuvette-receiving apertures having side walls adapted to frictionally receive and support each of said flexibly interconnected wells when said interconnected wells are inserted tapered end first into corresponding apertures of said tray, said apertures being defined by substantially rigidly disposed side walls defining said apertures, the side walls intersection to form each of said apertures, an inward wall of each of said apertures being severed to provide at least one flexibly deformable clamping element in each of said apertures for frictionally engaging and holding each of said wells.

2. The cuvette matrix and tray as in claim 1, wherein a peripheral shoulder is provided on each of said wells between the thickened upper portion and said lower tapered portion, and wherein stop means is provided in each of said apertures to engage said peripheral shoulder.

3. The cuvette matrix and tray of claim 2, wherein the apertures of said tray are quadrangular in shape.

4. The cuvette matrix and tray as in claim 3, wherein one or more interconnected wells can be removed from the matrix at a time.

5. The cuvette matrix and tray as in claim 4, wherein said connecting stems are breakable such that a well si removable by breaking the stem connected to said well.

6. The cuvette matrix and tray as in claim 5, wherein the breakable stems flexibly interconnecting one well to the other are connectingly disposed along the sides of the wells, or along alternate sides thereof.

7. The cuvette matrix and tray as in claim 3, wherein said severed inward wall of each of said apertures is configurated as a deformable flexible finger for frictionally holding the confined well against an opposite wall of said aperture.

8. The cuvette matrix and tray as in claim 7, wherein said flexible finger is adapted to be horizontally flexible.

9. The cuvette matrix and tray as in claim 8, wherein said aperture has only one finger for holding said well therein.

10. The cuvette matrix and tray as in claim 1, wherein the closed bottom of each of said well is optically light transmitting.

11. The cuvette matrix and tray as in claim 1, wherein said inward wall of each of said apertures in said tray is severed diagonally at substantially the center of said side wall to provide a diagonal gap in said inward wall and thereby form a pair of fingers which flex horizontally when a cuvette is frictionally forced into said aperture.

* * * * *

UNITED STATES PATENT AND TRADEMARK OFFICE

CERTIFICATE OF CORRECTION

PATENT NO. : 5,096,672

DATED : March 17, 1992

INVENTOR(S) : Jukka Tervamaki

It is certified that error appears in the above-identified patent and that said Letters Patent is hereby corrected as shown below:

Column 1, line 17, "8>12 cuvettes" should be --8x12 cuvettes--.

Column 2, line 3, after "matrix" please insert --may be--.

Signed and Sealed this

First Day of June, 1993

Attest:

Michael K. Kirk

MICHAEL K. KIRK

Attesting Officer

Acting Commissioner of Patents and Trademarks